United States Patent [19]

Allgeyer

[11] Patent Number: 4,496,201

[45] Date of Patent: Jan. 29, 1985

[54] CLOSURE SUCH AS A GLASS DOOR FOR A REFRIGERATION OR FREEZER

[75] Inventor: David F. Allgeyer, Conway, Ark.

[73] Assignee: UMC Industries, Inc., Stamford, Conn.

[21] Appl. No.: 401,117

[22] Filed: Jul. 23, 1982

[51] Int. Cl.[3] ..... E06B 3/64

[52] U.S. Cl. ..... 312/296; 49/501; 52/718; 312/138 R; 312/214

[58] Field of Search ..... 312/214, 140, 138 R, 312/116, 296; 248/345.1; 49/402, 501, 70; 52/821, 476, 716, 718

[56] References Cited

U.S. PATENT DOCUMENTS

| | | | |
|---|---|---|---|
| 3,063,524 | 11/1962 | Kessler | 52/476 |
| 3,363,385 | 1/1968 | Evans et al. | 52/476 |
| 3,455,080 | 7/1969 | Meadows | 52/716 |
| 3,631,630 | 1/1972 | Buffington et al. | 49/402 |
| 3,774,363 | 11/1973 | Kent | 52/718 |
| 3,882,637 | 5/1975 | Lindenschmidt | 49/501 |
| 4,087,139 | 5/1978 | Heaney | 312/138 R |
| 4,134,626 | 1/1979 | Kordes | 312/214 |
| 4,165,083 | 8/1979 | Dochnahl | 52/718 |
| 4,248,489 | 2/1981 | Barroero et al. | 49/402 |
| 4,304,075 | 12/1981 | Miyoshi | 52/718 |

FOREIGN PATENT DOCUMENTS

| | | | |
|---|---|---|---|
| 624812 | 9/1961 | Italy | 312/214 |

*Primary Examiner*—William E. Lyddane
*Assistant Examiner*—Thomas A. Rendos
*Attorney, Agent, or Firm*—Senniger, Powers, Leavitt and Roedel

[57] ABSTRACT

A glass door for a refrigerator or freezer having an open rectangular frame around the glass, the top, bottom and sides of the frame each comprising a front metal extrusion and a rear plastic extrusion, the front extrusion having a part extending in front of the glass and the rear having a part extending in back of the glass, the extrusions being snap-fitted together with the glass between said parts, the plastic rear members being of low thermal conductivity relative to the metal front members for reduced heat transfer from the metal front members through the plastic rear members to maintain the metal front members warmer and avoid condensation of moisture on the exposed surfaces thereof.

1 Claim, 3 Drawing Figures

CLOSURE SUCH AS A GLASS DOOR FOR A REFRIGERATION OR FREEZER

BACKGROUND OF THE INVENTION

This invention relates to closures, and more particularly to a closure such as a door comprising glass in a frame subject to cold air on one side and warmer humid air on the other.

The invention is especially concerned with a glass door for a refrigerator or freezer, more particularly a refrigerator or freezer such as is used in retail food stores, being of glass for viewing the contents of the refrigerator or freezer. Such doors as heretofore supplied on refrigerators and freezers manufactured by Universal Nolin Division of the assignee of this invention have comprised double-pane or triple-pane glass in a metal (aluminum) frame, the frame being made of metal for structural integrity of the completed door assembly. These doors are subject to cold air from the refrigerator or freezer on the inside or rear, and warmer air (which is often quite humid) on the outside or front. While the metal (aluminum) may be covered in some fashion in an attempt to minimize condensation of moisture on the exposed surfaces of the frame (the warm side surfaces), it has generally been found necessary for effectively inhibiting condensation to incorporate an electrical resistance heating wire or wires in the frame to keep it warm for this purpose. This not only adds to the cost of the door, but also imposes additional costs for operation of the refrigerator or freezer on account of the electrical power consumption for warming the frame. In a typical situation this power consumption is 65 watts per door, which equals 1.6 KWH a day, and at an average KWH cost of about 7¢, this amounts to $80 per year for a 2-door cabinet just to warm the door frames.

SUMMARY OF THE INVENTION

Among the several objects of the invention may be noted the provision of a closure, such as a glass door for a refrigerator or freezer, having a frame which while imparting structural integrity to the closure is of such construction as to inhibit condensation of moisture on its exposed surfaces; and the provision of a glass door with such a frame which is itself not only of simple and economical construction and easy to assemble with the glass, but which also eliminates any need for electrical heating means in the frame, thereby not only saving on the initial cost of the door but also eliminating the need for electrical power for warming the frame, and the cost of such power.

In general, a closure of this invention is one that is exposed to relatively warm ambient air, which may be humid, at one face constituting its front and to relatively cold ambient air at its other face constituting its rear, and comprises an open rectangular frame having a top, bottom and sides and a closure panel, which is of low thermal conductivity, in the frame, the top, bottom and both sides of the frame each comprising a front member of metal (e.g., aluminum) and a rear member of plastic, the front member having a part extending in front of the closure panel and the second having a part extending in back of the closure panel, and means for securing said members together with the closure panel between said parts, the plastic rear members being of low thermal conductivity relative to the metal front members for reduced heat transfer from the metal front members through the plastic rear members to maintain the metal front members warmer and avoid condensation of moisture on the exposed surfaces thereof.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
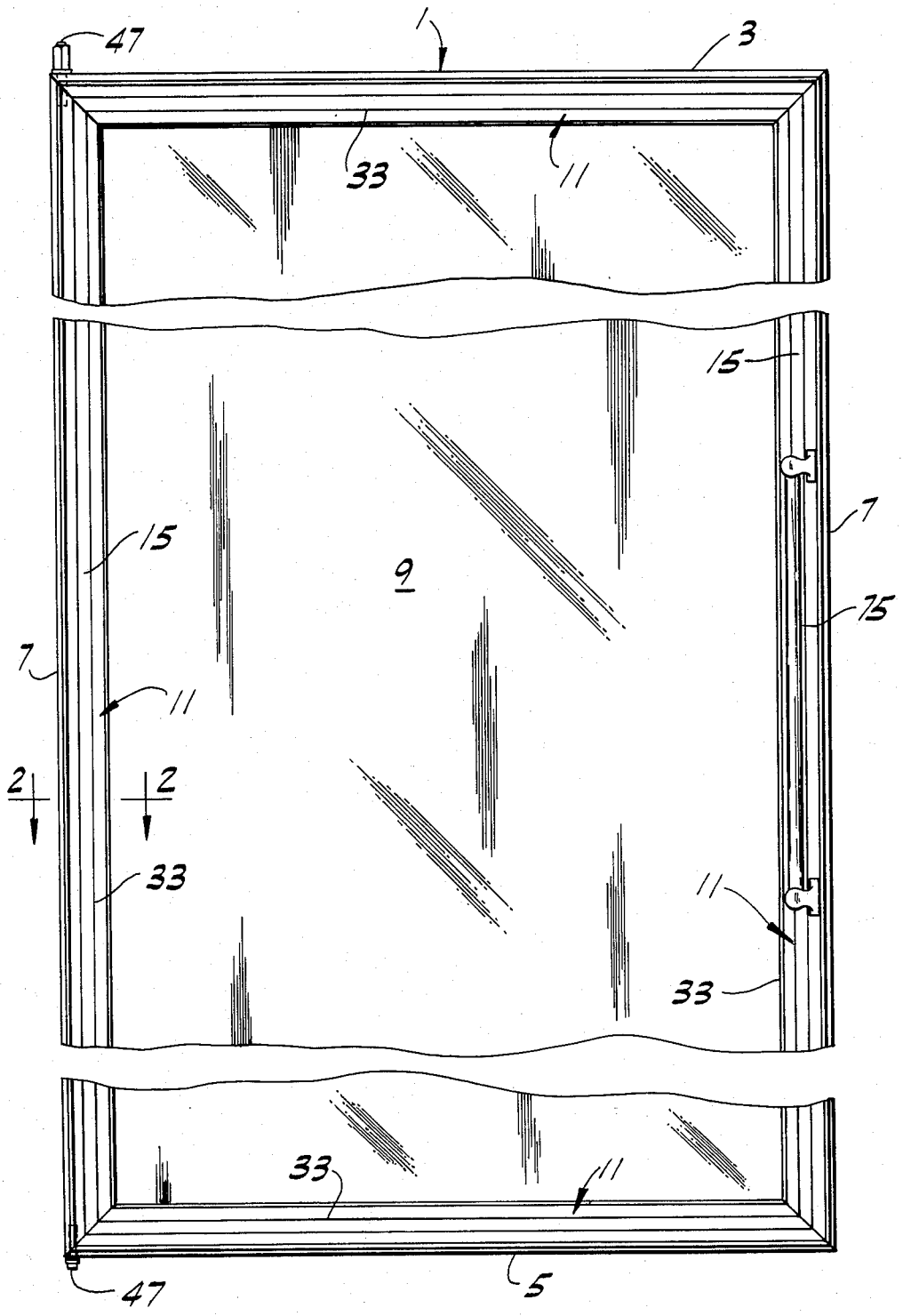
FIG. 1 is a view in front elevation of a door of this invention, parts being broken away to reduce the size of the view.
Figure 2:
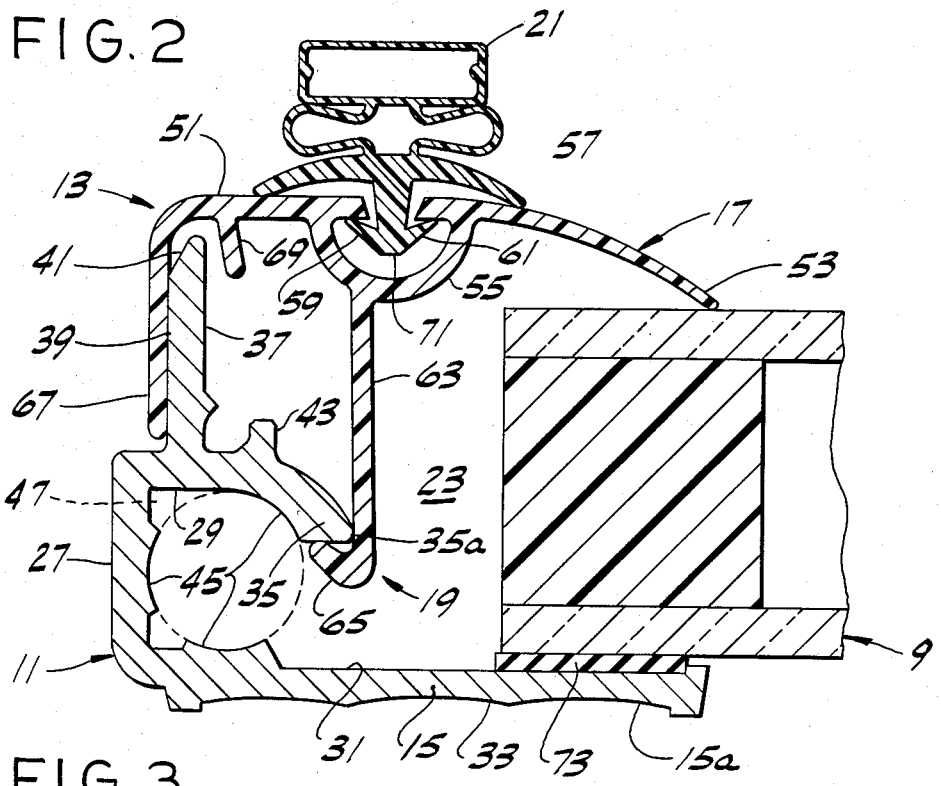
FIG. 2 is an enlarged section on line 2—2 of FIG. 1.

Referring to FIGS. 1 and 2 of the drawings, a closure of this invention constituting a door for a refrigerator or freezer is shown to comprise a rectangular frame 1 having a top 3, bottom 5 and sides 7, and a closure panel 9 of glass in the frame. The top, bottom and sides of the frame each comprise a member 11 of metal, more particularly aluminum, at the front of the frame, and a member 13 of plastic, preferably polyvinyl chloride (PVC), at the rear of the frame. The "front" is that face of the frame which is toward the front or on the outside as the door is applied to the cabinet of a refrigerator or freezer, i.e., the face exposed to warm ambient room air, and the "rear" is that face toward the inside of the cabinet, i.e., the face exposed to cold ambient air in the refrigerator or freezer. The front member 11 of each of the frame members 3, 5 and 7 has a part 15 in the form of a relatively thin flange extending in front of the closure panel or glass 9, and the rear member 13 has a part 17 also in the form of a flange extending in back of the closure panel or glass. Means indicated generally at 19 is provided for securing the front and rear members 11 and 13 together with the glass 9 between the flanges 15 and 17. The rear members 13 of the frame members 3, 5 and 7, being of plastic, are of low thermal conductivity relative to the metal front members 11. As a result, heat transfer from the metal front members 11 through the plastic rear members 13 is reduced to maintain the metal front members warmer and avoid condensation of moisture on the exposed surfaces thereof.

The door 1 has a seal or gasket indicated at 21 at the rear of the frame 1 extending all around the frame for asusual sealing engagement with the cabinet of the refrigerator or freezer. The front and rear members 11 and 13 are of such transverse cross section as to provide a space 23 within the frame for thermal insulation purposes all around the glass 9. This space may be left as is, as in FIG. 2, or filled with a foamed-in-place plastic foam thermal insulation material as indicated at 25 in FIG. 3. The means 19 for securing the front and rear frame members 11 and 13 together generally comprises interengaging fastening elements on these members, the fastening elements on the rear members being adapted for snap engagement with the fastening elements on the front members as will be described later. The glass 9 as illustrated is the usual doublepane glass unit as conventionally used for refrigerator and freezer doors. It may be a triple-pane unit.

The front member 11 of each of the top, bottom and sides 3, 5 and 7 of the frame 1 is preferably a length of an aluminum extrusion of such transverse cross section as to have a relatively narrow web 27 at what may be regarded as the outside of the member generally in a front-to-rear plane with respect to the door. The flange 15 extends inwardly from the web 27 generally at right angles to the web at the front margin of the web. A flange 29 constituting part of the means 19 for securing the front and rear members 11 and 13 together extends inwardly from the web 27 generally at right angles to the web at the rear margin of the web. The front flange 15 may be interiorly recessed as indicated at 31 and may be scalloped on its front face as indicated at 33 for trim purposes. Its inner margin, indicated at 15*a*, extends in front of the glass 9. The rear flange 29 of the metal front member 11 is narrower than the front flange 15 and has a lip 35 at its inner margin curved toward the front (i.e., curved toward the front flange 15). The edge of this lip is spaced well outward from the edge of the glass 9. A rib or tongue 37 extends rearward from the rear flange 29 of the member 11 generally at right angles to flange 29 spaced inward from the web 27. This tongue 37 has a flat outside face 39 and is beveled or chamfered on the outside at its rear margin as indicated at 41. The rear flange 29 has a narrow rib 43 inward of tongue 37. The web 27, the flange 15 and the lip 35 of the rear flange 29 have arcuate interior formations indicated at 45 for accommodation of hinge pins 47 at the top and bottom of the frame at one side thereof.

The rear member 13 of each of the top, bottom and sides 3, 5 and 7 of the frame 1 is preferably a length of a plastic extrusion, the plastic preferably being polyvinyl chloride (PVC), of such transverse cross section as to provide the flange 17 which extends in back of the glass. This flange has a flat outer portion 51 and a curved inner lip portion 53 joined by a semicircular bridge portion 55 at the front of the flange, with a slot at 57 between the inside edge 59 of the flat outer portion 51 and the outside edge 61 of the curved lip portion 53. The latter is curved forward. Extending forward from the bridge portion 55 of the rear member 13 is a web 63 having a hook formation 65 of its forward edge adapted for snap hooking interengagement with the edge of the lip 35 of the front member 11. Extending forward from the outer margin of the flat outer portion 51 of flange 17 generally at right angles thereto is a web or rim 67 which is spaced outward from the web 63 a distance corresponding to the spacing of the rib 37 from the front-to-rear plane of the edge 35*a* of the lip 35. Member 13 is also shown as having a forwardly extending reinforcing rib 69 spaced somewhat inwardly from the rim 67 defining in conjunction with 69 a channel for the edge of the tongue 37. The slot 57 and the space within the bridge member 55 are adapted for entry of the double-hooked web portion 71 of the seal or gasket 21, which is of conventional form.

In the manufacture of the door, a subassembly is made of the four front metal members 11 for the top, bottom and sides of the door by cutting appropriate lengths of the metal extrusion for the top, bottom and sides, and welding the cut lengths together at their ends. As shown in FIG. 1, the subassembly of the metal frame parts has mitered corners. Double-side pressure-sensitive adhesive tape 73 as conventionally used in doors of the class under consideration is applied to the inside of the inner margins 15*a* of the flanges 15 of the subassembly of the four members 11 (top, bottom and sides) and the glass 9 is laid in the subassembly, the margin of the glass at the front of the glass engaging and adhering to the tape 73. The four plastic members 13 for the top, bottom and sides of the door are cut to length (with 45° ends) from the plastic extrusion and assembled with suitable temporary clamps at the corners. This subassembly of plastic members 13 is assembled with the metal member subassembly and the glass 9 to complete the door by fitting the rims 67 of the plastic members subassembly on the outside of the tongues 37 of the front members 11, and sliding the rims 67 on the outside faces 39 of the tongues 37. As the subassembly of plastic members 13 is so moved toward the subassembly of front members 11 guided by the sliding interengagement of the rims 67 with the outside faces 39 of tongues 37, the hook formations 65 at the forward edges of webs 63 engage the curved backs of the curved lips 35 of the front members. With the members 13 formed of plastic such as polyvinyl chloride, the webs 63 of these members are flexible and resilient, and they are cammed to flex inwardly by the engagement of the hook formations 65 with the curved backs of the curved lips 35 until the hook formations 65 clear the edges 35*a* of the lips, whereupon the webs flex back outwardly (toward the left as viewed in FIG. 2) and the hook formations 65 snap in front of the lips. This secures the plastic rear members 13 to the metal front members 11. The inner lip portions 53 of the rear members 13 are flexible and resilient and resiliently engage the back of the glass as illustrated in FIG. 2. On completion of the assembly, the temporary clamps for the plastic members 13 are removed. The gasket 21 is then installed in the retaining slot 57.

The completed door, comprising the glass 9 and the aluminum/plastic frame 1, is assembled with the refrigerator or freezer cabinet on which it is to be used with the plastic members 13 of the frame toward the cabinet, so that the aluminum members 11 are on the outside and the plastic members 13 are on the inside relative to the cabinet. The aluminum members 11 tend to be heated by heat-exchange relationship with room air, whereas the plastic members 13 tend to be chilled by reason of their heat-exchange relationship with the refrigerator or freezer (e.g., their exposure to cold air in the cabinet of the refrigerator or freezer). The tendency is therefore for a transfer of heat from the aluminum members through the plastic members to the refrigerator or freezer, but the transfer is reduced because the plastic is of low thermal conductivity relative to the aluminum. Accordingly, the aluminum stays warmer and condensation on its front and side exposed surfaces is avoided.

Figure 3:
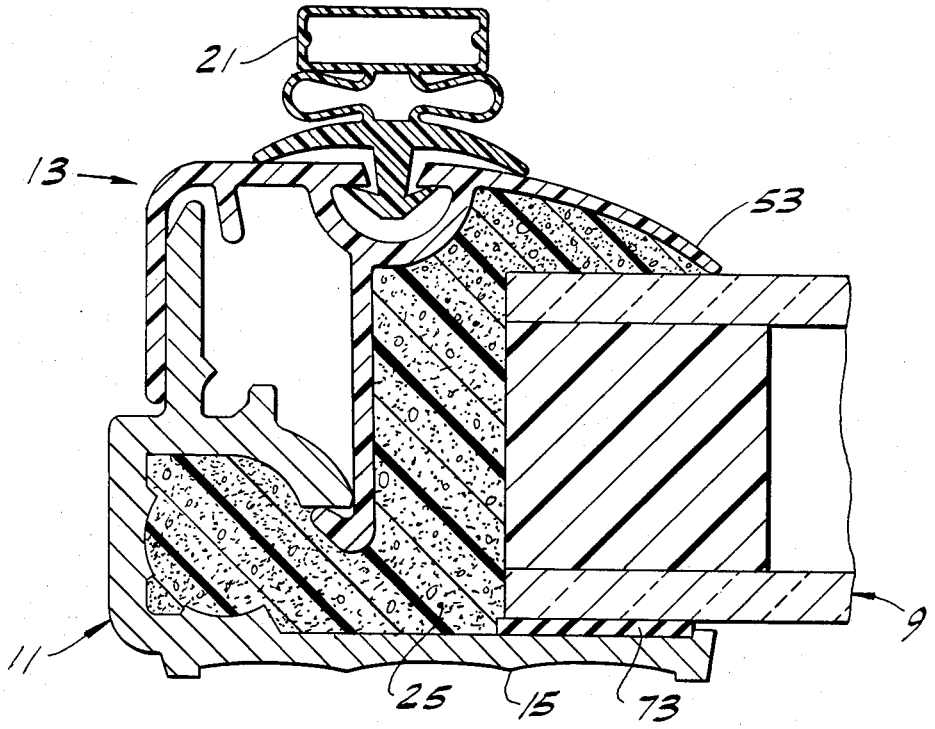
FIG. 3 is a view similar to FIG. 2 showing a modification.

While the space 23 may be left open, it is preferred that it be filled with foamed-in place plastic foam thermal insulation, e.g., foamed-in place polyurethane foam, as indicated at 25 in FIG. 3, since it has been found that this appears to maintain the aluminum somewhat warmer than leaving space 23 open. The foam insulation core also bonds with the inner material surfaces of the surrounding members for improved structural integrity and rigidity of the overall door assembly. The plastic for the foam may be injected into the space 23 through small holes drilled through flanges 15 or webs 27 at the four corners of the frame, these holes being subsequently suitably plugged.

The construction with the plastic members 13 as the rear members of the frame 1 enables the use of metal (aluminum) members 11 for structural integrity of the door, while avoiding the condensation problem, without the use of any electrical heating elements for the frame. A handle is indicated at 75 in FIG. 1.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A door for a refrigerator or freezer exposed to relatively warm ambient air, which may be humid, at one face constituting its front and to relatively cold ambient air at its other face constituting its rear, comprising:

an open rectangular frame having a top, bottom and sides and a glass panel in the frame, the top, bottom and both sides of the frame each comprising a front member of metal and a rear member of plastic, the front member having a part extending in front of the glass panel and the rear member having a part extending in back of the glass panel, and means for securing said members together with the glass panel between said parts;

the plastic rear members being of low thermal conductivity relative to the metal front members for reduced heat transfer from the metal front members through the plastic rear members to maintain the metal front members warmer and avoid condensation of moisture on the exposed surfaces thereof;

each front member being a length of an aluminum extrusion of such transverse cross section as to have a front flange comprising the part extending in front of the glass panel, a web extending rearward from the outer margin of the front flange a distance less than the thickness of the glass panel, a rear flange extending inward from the web at the rear of the web narrower than the front flange and having its inner margin spaced outward from the edge of the glass panel, said rear flange having a lip at its inner margin curved toward the front flange, and a rib extending rearward from the rear flange, the rib being spaced inward from the web;

said web and rear flange in conjunction with said front flange defining a formation for receving hinge pins at the top and bottom of one side of the door;

each rear member being a length of plastic extrusion of such transverse cross section as to have a second flange providing the part extending in back of the glass panel, a rim extending forward from the outer margin of said rear member flange in interengagement with the rib of the front member, and a hook member extending forward from said rear member flange in interengagement with said rear flange of a front member, said hook member comprising a resilient flexible web extending forward from said rear flange member having a hook formation at its forward edge engageable with said curved lip, said rear member flange comprising an outer portion and an inner lip portion joined by a bridge portion with a slot between the inside edge of the outer portion and the outside edge of the inner lip portion, the hook member extending forward from the bridge portion, and a gasket being provided all around the rear of the frame having a portion extending through the slot securing it in place, the gasket being engageable with the cabinet of the refrigerator or freezer;

said door having a space within the frame all around the glass panel bounded by the frame, the front flange, web and rear flange of each front member, and the hook member, the bridge portion and the inner lip portion of each rear member, said space being filled with a foamed-in-place plastic foam thermal insulation material.

* * * * *

UNITED STATES PATENT AND TRADEMARK OFFICE

CERTIFICATE OF CORRECTION

PATENT NO. : 4,496,201

DATED : January 29, 1985

INVENTOR(S) : David F. Allgeyer

It is certified that error appears in the above—identified patent and that said Letters Patent is hereby corrected as shown below:

Front page, item [54], CLOSURE SUCH AS A GLASS DOOR FOR A REFRIGERATION OR FREEZER" should read --CLOSURE SUCH AS A GLASS DOOR FOR A REFRIGERATOR OR FREEZER--; Column 6, line 9, "receving" should read --receiving--.

Signed and Sealed this

*Eighteenth* Day of *June 1985*

[SEAL]

*Attest:*

DONALD J. QUIGG

*Attesting Officer* *Acting Commissioner of Patents and Trademarks*